United States Patent [19]

Mabuchi

[11] Patent Number: 4,888,261

[45] Date of Patent: Dec. 19, 1989

[54] ELECTROPHOTOGRAPHIC PHOTSENSITIVE MEMBER

[75] Inventor: Minoru Mabuchi, Tokyo, Japan

[73] Assignee: Canon Kabushiki Kaisha, Tokyo, Japan

[21] Appl. No.: 198,566

[22] Filed: May 25, 1988

[30] Foreign Application Priority Data

Jun. 1, 1987 [JP] Japan ..... 62-137975

[51] Int. Cl.[4] ..... G03G 5/06

[52] U.S. Cl. ..... 430/56; 430/58

[58] Field of Search ..... 430/56, 58

[56] References Cited

U.S. PATENT DOCUMENTS

| | | | |
|---|---|---|---|
| 4,272,598 | 6/1981 | Sasaki et al. | 430/58 X |
| 4,279,981 | 7/1981 | Ohta et al. | 430/58 X |
| 4,299,896 | 11/1981 | Hashimoto et al. | 430/58 |
| 4,507,374 | 3/1985 | Kakuta et al. | 430/58 |
| 4,666,810 | 5/1987 | Umehara et al. | 430/58 X |
| 4,735,882 | 4/1988 | Yamashita et al. | 430/58 |
| 4,743,523 | 5/1988 | Yamashita et al. | 430/58 X |
| 4,760,003 | 7/1988 | Matsumoto et al. | 430/58 |

FOREIGN PATENT DOCUMENTS

| | | |
|---|---|---|
| 56-125454 | 10/1981 | Japan . |
| 59-61840 | 4/1984 | Japan . |
| 61-200545 | 9/1986 | Japan . |
| 62-148961 | 7/1987 | Japan . |

*Primary Examiner*—Paul R. Michl
*Assistant Examiner*—Jeffrey A. Lindeman
*Attorney, Agent, or Firm*—Fitzpatrick, Cella, Harper & Scinto

[57] ABSTRACT

An electrophotographic photosensitive member comprises a conductive support, and a photosensitive layer containing as azo pigment as a charge-generating material, wherein in a powder X-ray diffraction pattern of the azo pigment contained in said photosensitive layer the ratio (X) of the diffracted beam intensity at a maximum peak at $2\theta$ of from 5° to 20° to the X-ray intensity at the background is 0.8 or more, provided that:

$$X=(P-B)/B,$$

wherein

P: X-ray intensity at a peak position at the maximum peak; and

B: X-ray intensity at a peak position on the line connecting the bottoms at the both sides of the maximum peak.

7 Claims, 5 Drawing Sheets

ELECTROPHOTOGRAPHIC PHOTSENSITIVE MEMBER

BACKGROUND OF THE INVENTION

1. Field of the Invention

The present invention relates to an electrophotographic photosensitive member, and more particularly to an electrophotographic photosensitive member having a photosensitive layer containing a crystalline charge-generating material.

2. Related Background Art

Hitherto widely used as electrophotographic photosensitive members comprising an inorganic photoconductive material have been those employing selenium, cadmium sulfide, zinc sulfide or the like.

On the other hand, known electrophotographic photosensitive members comprising an organic photoconductive material are those employing photoconductive polymers as typified by poly-N-vinyl carbazole or low molecular organic photoconductive materials such as 2,5-bis(p-diethylaminophenyl)-1,2,3-oxadiazole, and also those comprising the combination of such organic photoconductive materials with all sorts of dyes or pigments.

The electrophotographic photosensitive members employing the organic photoconductive materials have the advantage that they can be produced by coating, can achieve a very high productivity, and can provide inexpensive photosensitive members. They also have the advantages such that the color-sensitivity can be arbitrarily controlled by appropriately selecting dyes or pigments to be used or sensitizers therefor, and thus have been studied over a wide range. Particularly, in recent years, a functionally separated photosensitive member comprising a charge generation layer comprised of an organic photoconductive pigment, laminated with the so-called charge transport layer comprised of the above-mentioned photoconductive polymer or low molecular organic photoconductive material, has been developed to bring about remarkable improvement in the sensitivity and durability in which the conventional organic electrophotographic photosensitive members have been regarded as defective, and has come to be put into practical use. Various compounds and pigments suitable for the functionally separated photosensitive member have also been discovered.

In such a functionally separated electrophotographic photosensitive member, a number of organic dyes or organic pigments are proposed in, for example, U.S. Pat. No. 4,356,246, U.S. Pat. No. 4,551,404, U.S. Pat. No. 4,571,369, U.S. Pat. No. 4,582,771, Patent Laid Open application No. 61-228453 and Patent Laid Open application No. 61-275850, as charged-generating materials therefor.

However, they can not necessarily be satisfactory for the sensitivity and the potential characteristics such as residual potential and stability in repeated use.

In recent years, with the spread of computers, there also developed progressively printers or copying machines in which semiconductor lasers, LED or the like are used as exposure light sources. Sought after as photosensitive members used in these are photosensitive members having a high sensitivity to near infrared light. The fact, however, it that those having a high sensitivity to near infrared region (particularly 750 nm or more) are only sparingly available among the organic dyes or organic pigments.

In instances where such organic dyes or organic pigments are used as charge-generating materials, the electrophotographic characteristics are known to be greatly affected by crystal forms including the non-crystalline form. For example, Patent Laid Open application No. 56-116038 discloses that crystalline bisazo pigments have sensitivity about 5 times greater as compared with that of non-crystalline ones. Patent Laid Open application No. 59-81647 also discloses that a non-crystalline bisazo pigment such that in a powder diffraction pattern the maximum value of the diffraction intensity at $2\theta=26°$ to $2\theta=28°$ on the basis of the diffraction intensity at $2\theta=35°$ is smaller than 3 times the average value of the diffraction intensity at $2\theta=18°$ to $2\theta=22°$ on the basis of the diffraction intensity at $2\theta=35°$ has a high sensitivity. Patent Laid Open application No. 51-108847 also discloses that a copper phthalocyanine pigment having a particular crystal form among a number of crystal forms of copper phthalocyanines can be an effective component of an electrophotographic photosensitive member. Thus, some report that crystalline materials have a higher sensitivity than non-crystalline materials depending on the types of organic dyes or organic pigments and on the contrary some report that non-crystalline materials have a higher sensitivity than crystalline materials. Accordingly, it has been considered difficult to predict how the crystal forms of the respective organic dyes or organic pigments affect the electrophotographic characteristics.

SUMMARY OF THE INVENTION

An object of the present invention is to provide an electrophotographic photosensitive member having high sensitivity and high durability.

Another object of the present invention is to provide an electrophotographic photosensitive member improved in a method for preparing a charge-generating material dispersion that can be applied in preparing an electrophotographic photosensitive member having high sensitivity and high durability.

A further object of the present invention is to provide an electrophotographic photosensitive member having high sensitivity particularly to a near infrared region of 750 nm or more.

In case where the organic dyes or pigments are used as charge-generating materials, the crystal forms thereof are known to affect electrophotographic characteristics as mentioned above, but it is quite unknown what kind of forms the dyes or pigments having good electrophotographic characteristics take in a photosensitive layer. More specifically, noting that synthesized dyes or pigments pass through various steps as exemplified by purification, post-treatment, dispersion, coating and drying before they are used as charge-generating materials in a photosensitive layer, the present inventors found that depending on the types of dyes or pigments, there can be various crystal forms such that powdery and non-crystalline dyes or pigments grow to crystalline ones in the above steps such as dispersion, or crystalline ones are transformed into those having different crystal forms. They also found that particularly in azo pigments those having a given value or more in the crystallization degree at the time when contained in a photosensitive layer as charge-generating materials can function as an effective component of the highly sensitive photosensitive member. The present invention has thus been accomplished.

Namely, the present invention is characterized by comprising an azo pigment which is a charge-generating material contained in a photosensitive layer, wherein in a powder diffraction pattern of the azo pigment the ratio (X) of the diffracted beam intensity at a maximum peak at $2\theta$ of from 5 to 20° to the background is 0.8 or more, preferably, 1.0 or more.

Here, $$X=(P-B)/B$$

X: called the crystallization degree.

P: X-ray intensity at a peak position at the maximum peak.

B: X-ray intensity at a peak position on the line connecting the bottoms at the both sides of the maximum peak.

DETAILED DESCRIPTION OF THE PREFERRED EMBODIMENTS

Figure 1:
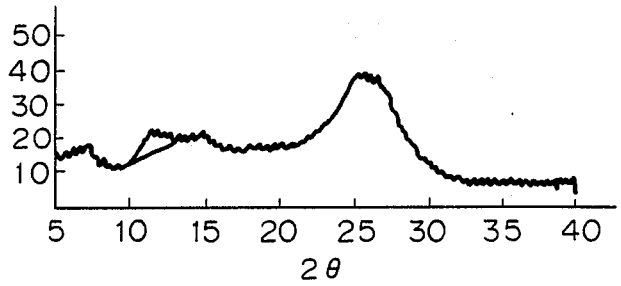
FIG. 1 to FIG. 13 are graphs of measurement by powder X-ray diffraction of the azo pigments used in the present invention.

The charge-generating material in the present invention is characterized by having a high crystallization degree in the photosensitive layer of an electrophotographic photosensitive member which is a final form of use, and this crystallization degree in the finally formed photosensitive layer can be controlled by beforehand finding the correlation with the crystallization degree of the charge-generating materials contained in a dispersion at the stage previous to the preparation of a photosensitive member and controlling the crystallization degree of the dispersion.

A method of measuring the crystallization degree of the charge-generating materials in the dispersion or a photosensitive member coating will be described below.

To collect the charge-generating materials from the dispersion, methods such as centrifugal separation are available, but this can be applied with difficulty since the charge-generating material dispersion for use in the electrophotographic photosensitive member have been stabilized in a highly atomized state. Of the methods of collecting it, most preferred is electrophoresis. More specifically, opposite electrodes are provided in the dispersion and a direct current field is applied, where fine particles of the charge-generating materials electrically migrate to one electrode since the surface of the particle forms an electrically double layer, and deposited on the electrode. This deposited charge-generating materials may be separated and formed into powder, so that it can be used for a sample for use in the power X-ray diffraction.

The charge-generating materials can be also collected from a photosensitive member coating. More specifically, a layer containing the charge-generating materials may be peeled from a photosensitive member by using a suitable solvent to make a dispersion, so that a sample for use in the powder X-ray diffraction can be prepared in the same manner as in the above collection from a dispersion.

The methods as described above enables the preparation and measurement of samples without any change in the crystallization degree of the azo pigment contained in the photosensitive layer.

The measurement of the crystallization degree is carried out by using the powder X-ray diffraction. An example thereof will be described below.

Geigerflex RAD-IIIA available from Rigaku Denki Co., Ltd was used as a powder X-ray diffraction apparatus, and measurement was made with Cu-K alpha-rays using Cu as the opposite cathode, and Ni as a filter, of an X-ray tube, under a tube voltage of 40 kV, a tube current of 30 mA, a $2\theta$ scanning speed of 4° per minute, and a time constant of 2 seconds. The crystallization degree (X) was defined as follows:

$$X=(P-B)/B$$

wherein:

P: X-ray intensity at a peak position at the maximum peak at $2\theta$ ranging from 5 to 20°.

B: X-ray intensity at a peak position on the line connecting the bottoms at the both sides of the maximum peak.

Examining the correlation between the crystallization degree of the charge-generating materials and the electrophotographic characteristics according to the above method of measuring the crystallization degree revealed that the sensitivity is dramatically improved when the crystallization degree is 0.8 or more.

Preferred as a means for controlling to 0.8 or more the crystallization degree of the charge-generating materials in the photosensitive layer is to previously control to 0.8 or more the crystallization degree of the charge-generating materials in a dispersion before preparation of a photosensitive member. To make such a dispersion, it is necessary to set dispersing conditions suited to the charge-generating materials used. Specifically, conditions such as dispersing solvents, dispersing binders, dispersing temperature, dispersing time, and share, constitute important factors. The crystal form and crystallization degree of the charge-generating materials having not been dispersed also constitutes an important factor. These are controlled by synthesis conditions and post-treatments. Thus there are various factors for controlling the crystallization degree, and the conditions should be set according to methods fitted to the properties of each charge-generating material. Some of the charge-generating materials, though having a crystallization degree of less than 0.5 in the dispersion, turn to have a crystallization degree of 0.8 or more in the photosensitive layer. However, in any case the crystallization degree of the charge-generating material in the finally formed photosensitive layer may be controlled based on the above measurement of the crystallization degree, so that it becomes possible to prepare a photosensitive member having high sensitivity and high durability, and thus the present invention has been accomplished.

The charge-generating materials as mentioned above can be readily prepared according to any known methods. These charge-generating materials are formed into fine particles by a dispersing means, and the photosensitive layer is formed by coating the resulting dispersion.

For example, to describe an embodiment of the present invention in respect of a composition of fine particles (1 μm or less, desirably 0.8 μm or less) of a disazo pigment, a diamine such as 2,5-bis(p-aminophenyl)-1,3,4-oxadiazole, 3,3'-dichlorobenzidine, diaminostilbene or diaminodistilbene is made into a tetrazo followed by coupling reaction with a coupler in the presence of an alkali, or a tetrazonium salt of the above diamine is once separated in the form of a borofluoride or a zinc chloride complex salt followed by azo-coupling reaction with a coupler in the presence of an alkali in a suitable solvent, thus synthesizing a disazo pigment. Subsequently, after filtration and washing with water, purification can be made by washing with a solvent such as dimethylformamide (DMF), dimethylacetamide (DMAC), methanol, ethanol, isopropyl alcohol (IPA), methyl ethyl ketone (MEK), methyl isobutyl ketone (MIBK), benzene, xylene, toluene or tetrahydrofuran (THF). Usable as the dispersing solvents for the pigments are all sorts of solvents including alcohol type solvents such as methanol, ethanol and IPA, ketone type solvents such as acetone, MEK, MIBK and cyclohexanone, and aromatic solvents such as benzene, toluene, xylene and chlorobenzene. The solvent used in the purification may be replaced if necessary by any of the above dispersing solvents to prepared a dispersion containing only the pigment, or alternatively a dispersion in which a binder resin is added can be made up. As the dispersing means, methods using sand mills, colloid mills, attritors, ball mills or the like can be utilized.

Usable as the binder resin are polyvinyl butyral, formal resins, polyamides, polyurethanes, cellulose resins, polyesters, polysulfones, styrene resins, polycarbonates, acrylic resins, etc.

A composition formed into fine particles can be prepared in the same manner also in regard to azo pigments (such as monoazo pigments and trisazo pigments) other than the above disazo pigments.

In any instances it is required to set the synthesis conditions and dispersing conditions so that the crystallization degree of the charge-generating materials in the finally formed photosensitive layer is controlled to 0.8 or more. Also, the dispersing conditions must be set so as to satisfy the coating suitability in addition to the crystallization degree.

The charge generation layer can be formed by coating the above dispersion directly on a conductive support or on a subbing layer. It can be also formed by coating it on a charge transport layer. The charge transport layer may preferably comprise a thin film layer having a film thickness of 0.01 to 1 μm. A greater part of the amount of incident light is absorbed in the charge generation layer to produce a large number of charge carriers, and moreover the charge carriers generated are required to be injected into the charge transport layer without deactivation by recombination or trapping. For this reason the above film thickness is preferred.

The coating can be carried out by using coating methods such as dip coating, spray coating, spinner coating, bead coating, Meyer bar coating, blade coating, roller coating and curtain coating. The drying may preferably be carried out by a method comprising bringing a coating into dryness to the touch at room temperature followed by heat drying. The heat drying can be carried out at a temperature of from 30° C. to 200° C., in a time ranging from 5 minutes to 2 hours, and in still air or under air blow.

The charge transport layer is electrically connected with the charge generation layer described above, and has functions to receive charge carriers injected from the charge generation layer in the presence of an electric field and transport the charge carriers to the surface. In this occasion, this charge transport layer may be laminated on the charge generation layer, or may otherwise be laminated beneath it. However, the charge transport layer may desirably laminated on the charge generation layer.

Materials to transport the charge carriers in the charge transport layer (hereinafter "charge-transporting materials") may preferably be substantially non-sensitive to the wavelength region of an electromagnetic wave to which the above charge generation layer is sensitive. The "electromagnetic wave" herein mentioned includes the definition for "light rays" in a broad sense including gamma-rays, X-rays, ultraviolet rays, visible light rays, near infrared rays, infrared rays and far infrared rays. When a light-sensitive wavelength region of the charge transport layer is coincident or overlaps with that of the charge generation layer, the charge carriers generated in the both layers are mutually captured, resulting in causing a lowering of sensitivity.

The charge-transporting materials include an electron transporting material and a positive hole transporting material. The electron transporting material includes electron attractive materials such as chloroanil, bromoanil, tetracyanoethylene, tetracyanoquinodimethane, 2,4,7-trinitro-9-fluolenone, 2,4,5,7-tetranitro-9-fluolenone, 2,4,7-trinitro-9-dicyanomethylenefluorenone, 2,4,5,7-tetranitroxanthone and 2,4,8-trinitrothioxanthone, or those obtained by forming these electron attractive materials into polymers.

The positive hole transporting material includes hydrazone compounds such as pyrene, N-ethylcarbazole, N-isopropylcarbazole, N-methyl-N-phenylhydrazino-3-methylidine-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N-alpha-naphthyl-N-phenylhydrazino and p-diethylbenzaldehyde-3-methylbenzothiazolinone-2-hydrazone, pyrazoline compounds such as 1-phenyl-3-(p-diethylaminostyryl)-5-(p-diethylaminophenyl)pyrazoline, 1-[pyridyl(2)]-3-(p-diethylaminostyryl)-5-(p-diethylaminophenyl)-pyrazoline, 1-[6-methoxypyridyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-phenyl-3-(alpha-benzyl-p-diethylaminostyryl)-5-(p-diethylaminophenyl)-pyrazoline and spiropyrazoline, styryl compounds such as alpha-phenyl-4-N,N-diphenylaminostilbene, N-ethyl-3-(alpha-phenylstyryl)carbazole and 5-p-ditolylaminobenzilidene-5H-dibenzo[a,d]cycloheptene, oxazole compounds such as 2-(p-diethylaminostyryl)-6-diethylaminobenzoxazole and 2-(p-diethylaminophenyl)-4-p-dimethylaminophenyl)-5-(2-chlorophenyl-)oxazole, thiazole compounds such as 2-(p-diethylaminostyryl)-6-diethylaminobenzothiazole, triarylmethane compounds such as bis(4-diethylamino-2-methylphenyl)-phenylmethane, polyarylalkanes such as 1,1-bis(4-N,N-diethylamino-2-methylphenyl)heptane and 1,1,2,2-tetrakis(4-N,N-dimethylamino-2-methylphenyl)ethane, triphenylamine, poly-N-vinyl carbazole, polyvinyl pyrene, polyvinyl anthracene, polyvinyl acrydine, poly-9-vinyl phenylanthracene, pyrene-formaldehyde resin, ethylcarbazole formaldehyde resin, etc.

Also, these charge-transporting materials can be used along or in combination of two or more.

If the charge-transporting material has no film-forming property, a film can be formed by selecting a suitable binder. Resins usable as the binder may include, for example, insulating resins such as acrylic resins, polyacrylates, polyesters, polycarbonates, polystyrene, an acrylonitrile/styrene copolymer, an acrylonitrile/-butadiene copolymer, polyvinyl butyral, polyvinyl formal, polysulfones, polyacrylamides, polyamides and chlorinated rubber, or organic photoconductive polymers such as poly-N-vinyl carbazole, polyvinyl anthracene and polyvinyl pyrene.

The charge transport layer has a limit in the capability of transporting charge carriers, and therefore can not be made to have an unnecessarily large film thickness. In general, it may have a thickness of from 5 μm to 30 μm, but preferably in the range of from 8 μm to 20 μm. In forming the charge transport layer by coating, suitable coating methods as previously described can be used.

The photosensitive layer composed of a laminated structure comprising such a charge generation layer and charge transport layer is in general provided on a conductive support. Usable as the conductive support are those which the support itself is conductive, as exemplified by those made of aluminum, aluminum alloys, copper, zinc, stainless steel, vanadium, molybdenum, chromium, titanium, nickel, indium gold, platinum or the like. Besides these, there can be also used plastics having a layer formed into a film by vacuum depositing of aluminum, aluminum alloys, indium oxide, tin oxide, an indium oxide/tin oxide alloy or the like, supports comprising the above metals or plastics covered thereon with conductive particles (as exemplified by carbon black and silver particles) together with a suitable binder, supports comprising plastics or paper impregnated with the conductive particles, and supports comprising plastics having conductive polymers.

A subbing layer having a barrier function and an adhesion function may be provided between the conductive support and the photosensitive layer. The subbing layer can be formed by casein, polyvinyl alcohol, nitrocellulose, an ethylene/acrylic acid copolymer, polyamides (such as nylon 6, nylon 66, nylon 610, copolymer nylon and alkoxymethylated nylon), polyurethanes, gelatin, aluminum oxide, etc.

The subbing layer may suitably have a film thickness of from 0.1 μm to 5 μm, preferably from 0.3 μm to 3 μm.

When the charge-transporting material comprises the electron transporting material in an instance where a photosensitive layer comprising the conductive support, charge generation layer and charge transport layer laminated in this order is used, the surface of the charge transport layer is required to be positively charged. Once it is charged and thereafter exposed to light, the electrons formed in the charge generation layer are injected into the charge transport layer at exposed areas, and subsequently reach the surface to neutralize the positive charge, where the surface potential is decayed and an electrostatic contrast is produced between exposed areas and unexposed areas. The electrostatic latent image thus formed may be developed with a negatively chargeable toner to obtain a visible image. This image may be directly fixed, or a toner image may be transferred to paper, plastic film or the like followed by developing and fixing.

There can be also employed a method in which an electrostatic latent image on a photosensitive member is transferred to an insulating layer of a transfer paper, followed by developing and fixing. As to the types of developing agents, developing methods and fixing methods, any known types and known methods may be employed, without limitation to any particular ones.

When, on the other hand, the charge-transporting material comprises the positive hole transporting material, the surface of the charge transport layer is required to be negatively charged. Once it is charged and thereafter exposed to light, the positive holes formed in the charge generation layer are injected into the charge transport layer at exposed areas, and subsequently reach the surface to neutralize the negative charge, where the surface potential is decayed and an electrostatic contrast is produced between exposed areas and unexposed areas. In developing, a positively chargeable toner must be used in contrast with the instance where the electron transporting material was used.

Another embodiment of the present invention may include an electrophotographic photosensitive member wherein the azo pigment described above is contained in the same layer together with the charge-transporting material. In this instance, a charge transporting complex compound comprising poly-N-vinyl carbazole and trinitrofluorenone can be used in addition to the charge-transporting material described above.

The electrophotographic photosensitive member of this embodiment can be prepared by dispersing the organic photosensitive member described above and the charge transporting complex compound in a solution of polyester dissolved in tetrahydrofuran, followed by film formation.

Any of the photosensitive members contain at least one azo pigment, and also can optionally use two or more of pigments for the purposes of increasing the sensitivity of a photosensitive member employing pigments of different light absorption in combination, or obtaining a panchromatic photosensitive member.

The electrophotographic photosensitive member can be not only utilized in electrophotographic copying machines, but also widely used in the field in which the electrophotography is applied as exemplified by laser printers, CRT printers and electronic engravers.

The photoconductive composition used in the present invention can be also used in solar cells and photosensors, without limitation to the electrophotographic photosensitive member described above.

A process for preparing the electrophotographic photosensitive member of the present invention will be described below in detail.

Examples of the azo pigments which are charge-generating materials useful for the present invention may include, for example, those having the following structural formulas, but the charge-generating materials of the present invention are by no means limited by these.

(1)
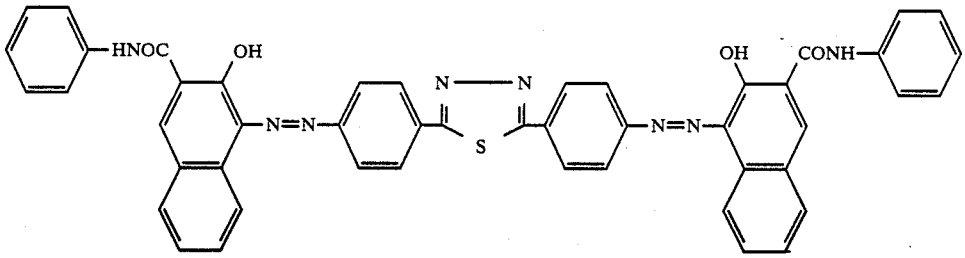
(2)
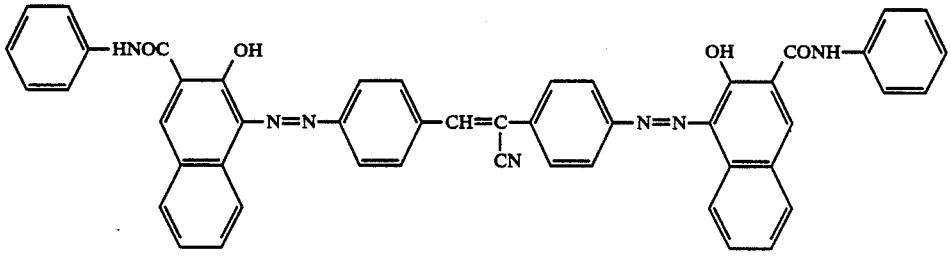
(3)
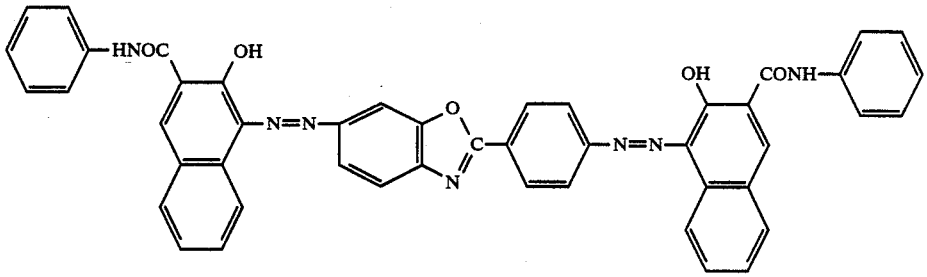
(4)
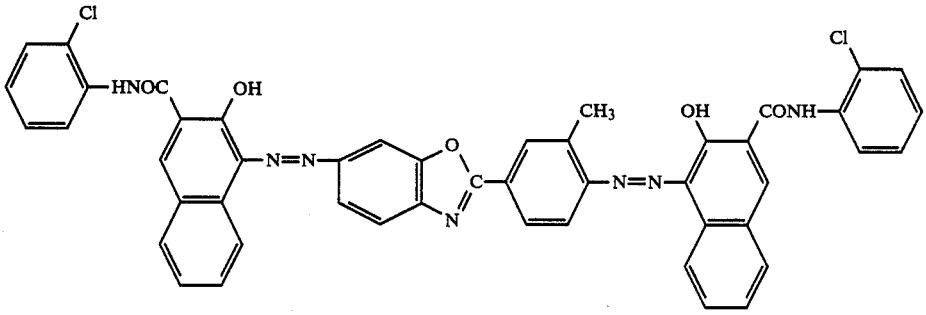
(5)
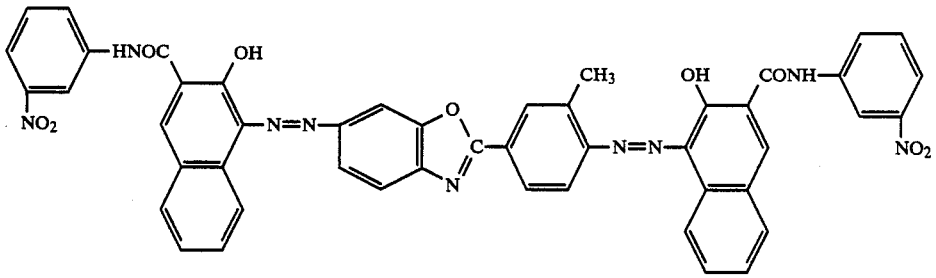
(6)
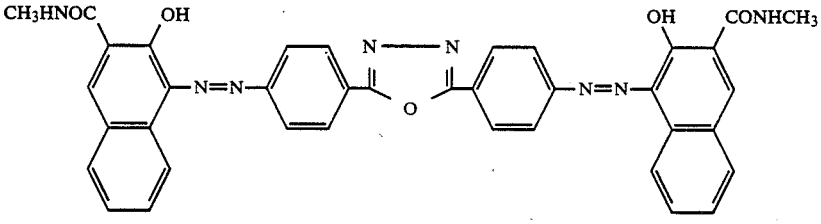

-continued
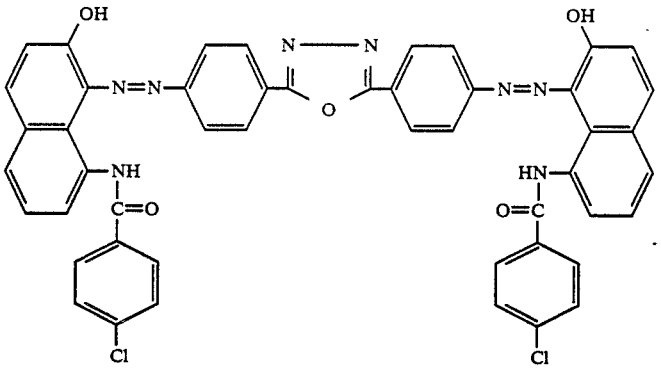
(7)
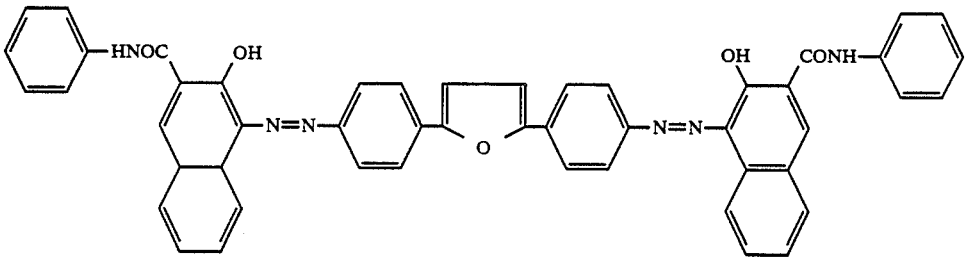
(8)
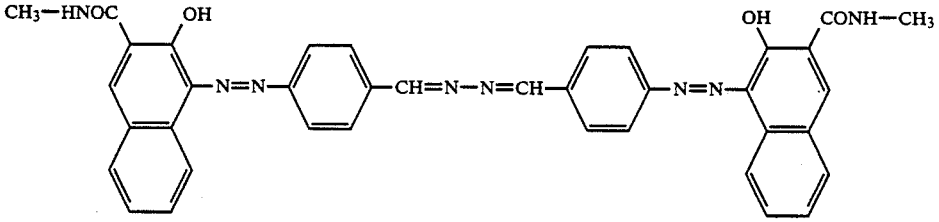
(9)
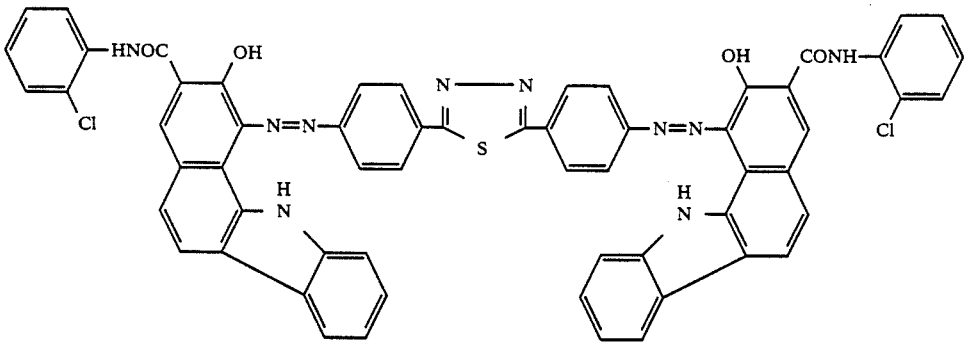
(10)
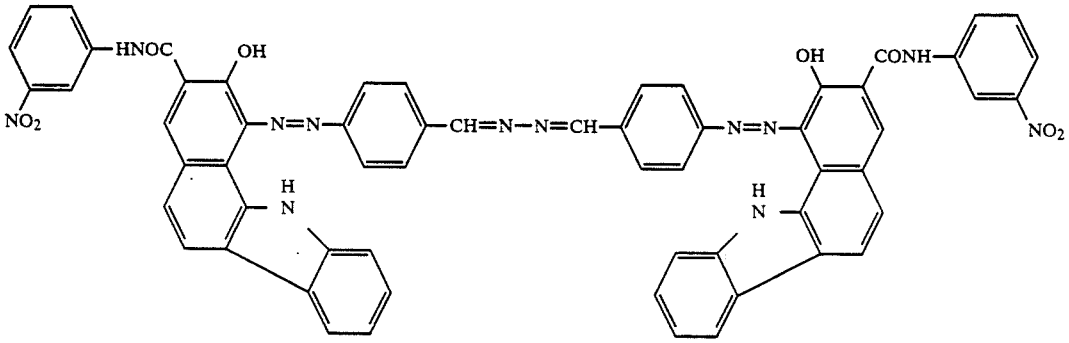
(11)

-continued (12)

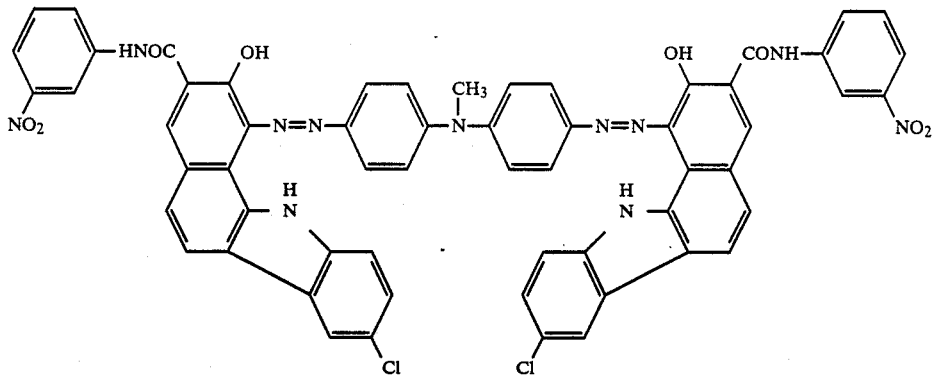

(13)

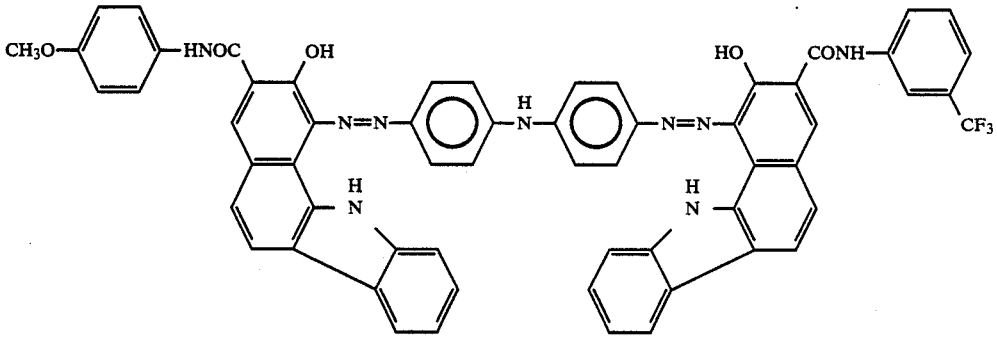

Next, typical synthesis examples for the disazo pigments used in the present invention are shown below.

SYNTHESIS EXAMPLE 1

(Synthesis of Exemplary Compound No. 12 shown above)

In a 500 ml beaker, 80 ml of water, 49.7 ml (0.563 mol) of concentrated hydrochloric acid and 10 g (0.047 mol) of diamine shown below were charged, and the liquid temperature was kept to 3° C. with stirring in an ice-water bath.

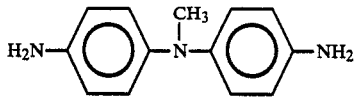

Next, a solution obtained by dissolving 6.93 g (0.00986 mol) of sodium nitrite in 20 ml of water was dropwise added over a period of 20 minutes while controlling the liquid temperature in the range of from 3° to 10° C., and, after completion of the dropwise addition, the reaction mixture was further stirred for 30 minutes at the same temperature. Carbon was added in the reaction mixture, followed by filtration to obtain a tetrazo-formed solution.

Next, in the tetrazo-formed solution a solution obtained by dissolving 20.5 g (0.187 mol) of sodium borofluoride in 40 ml of water was added to collect by filtration the deposited tetrazonium borofluoride.

On the other hand, in a 5 lit. beaker, 2 lit. of N,N-dimethylformamide were charged and 33.1 g (0.0767 mol) of a coupler shown below were dissolved.

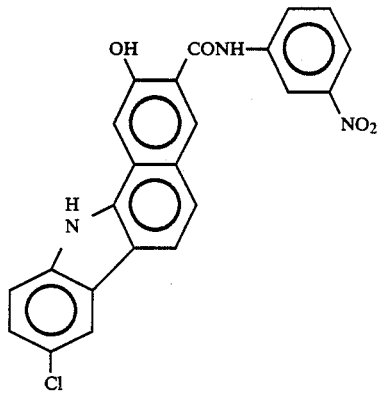

Thereafter the liquid temperature was kept to 5° to 10° C., and 15 g (dry base; 0.0365 mol) of the above tetrazonium borofluoride were added and dissolved, followed by dropwise addition of 7.76 g (0.0767 mol) of triethylamine.

The resulting crude pigment collected by filtration after completion of the reaction was subjected to dispersing, washing and filtration with use of 2 lit, of N,N-dimethylformamide, which were repeated four times, and further washing with water and filtration were repeated three times, followed by drying under reduced pressure to obtain 36.9 g of a purified pigment. Yield: 92.0%.

| | Calculated (%) | Found (%) |
|---|---|---|
| C | 64.48 | 64.90 |
| H | 3.40 | 3.32 |

-continued

| | Calculated (%) | Found (%) |
|---|---|---|
| N | 14.02 | 13.98 |

EXAMPLES

The present invention will be described below in greater detail by Examples.

EXAMPLE 1

On an aluminum sheet, a solution obtained by dissolving 10 parts (by weight; the same applies hereinafter) of copolymer nylon (tradename: Amilan CM-8000; available from Toray K. K. in a mixed solvent of 60 parts of methanol with 30 parts of butanol was coated by Meyer bar coating to have a film thickness of 0.7 μm after dried, followed by drying for 10 minutes at 100° C. to form a subbing layer.

Next, 10 parts of the disazo pigment (Exemplary Compound No. 12) shown in the above synthesis example, 6 parts of a cellulose acetate butyrate resin (trade name: CAB-381; available from Eastman Chemical Products, Inc.) and 60 parts of cyclohexanone were dispersed for 40 hours at 20° C. with use of a sand mill apparatus using glass beads of 1 mm in diameter. In the resulting dispersion, 100 parts of methyl ethyl ketone were added, and the solution was coated on the above subbing layer by Meyer bar coating to have a film thickness of 0.2 μm after dried, followed by drying for 10 minutes at 100° C. to obtain a charge generation layer.

Subsequently, 10 parts of a hydrazone compound of the formula shown below:

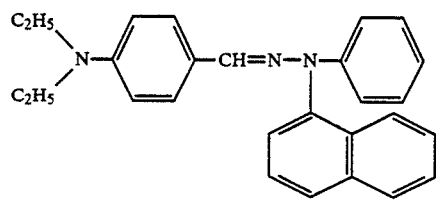

and 12 parts of a styrene/methyl methacrylate copolymer resin (MS-200; available from Seitetsu Kagaku Co., Ltd.) were dissolved in 70 parts of toluene, and the resulting solution was coated on the charge generation layer by Meyer bar coating to have a film thickness of 16 μm after dried, followed by drying for 60 minutes at 100° C. to form a charge transport layer, thus obtaining an electrophotographic photosensitive member.

EXAMPLE 2

Example 1 was repeated to obtain an electrophotographic photosensitive member, except that the conditions for the dispersing using the sand mill apparatus in Example 1 were changed to 30° C. and 25 hours.

COMPARATIVE EXAMPLE 1

Example 1 was repeated to obtain an electrophotographic photosensitive member, except that the conditions for the dispersing using the sand mill apparatus in Example 1 were changed to 10 hours.

The electrophotographic photosensitive members thus prepared were corona-charged under −5 kV according to a static system with use of a modified machine obtained by replacing the tungsten light source of an electrostatic copy paper test machine (Model SP-428, available from Kawaguchi Denki K.K.) with a 780 nm semiconductor laser and a scanning unit thereof, and kept in the dark place for 1 second, followed by exposure using the above laser beam to examine their charge characteristics. Measured as the charge characteristics were the surface potential ($V_o$) and the exposure amount E1/5) required for decaying to 1/5 the potential in dark-decaying for 1 second. Measurement of the powder X-ray diffraction was also made on the charge-generating materials collected before dispersing the charge-generating materials used in forming the above charge transport layer, collected from the dispersions, and collected from the finally formed electrophotographic photosensitive members, respectively.

Results of measurement of the above charge characteristics and powder X-ray diffraction are shown in Table 1.

TABLE 1

Figure 2:
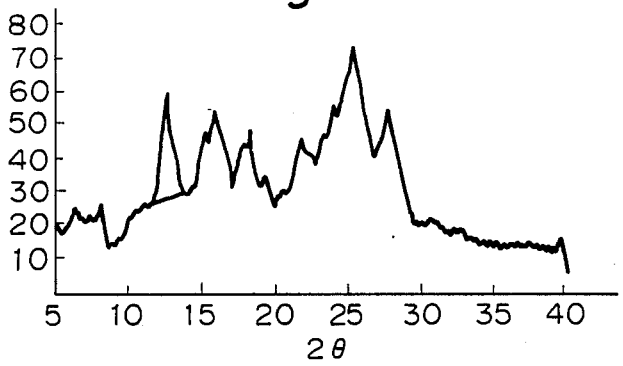
Figure 3:
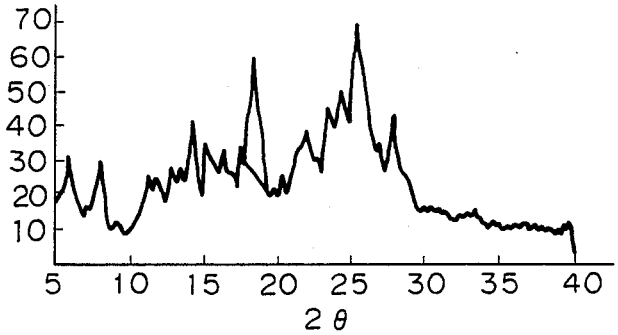
Figure 4:
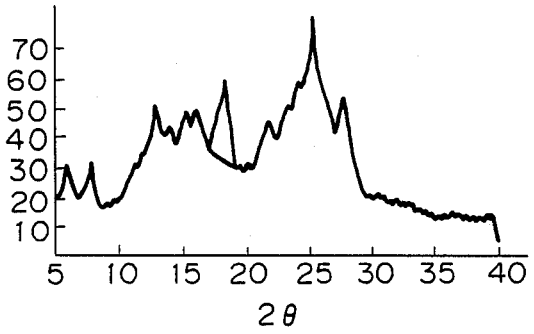
Figure 5:
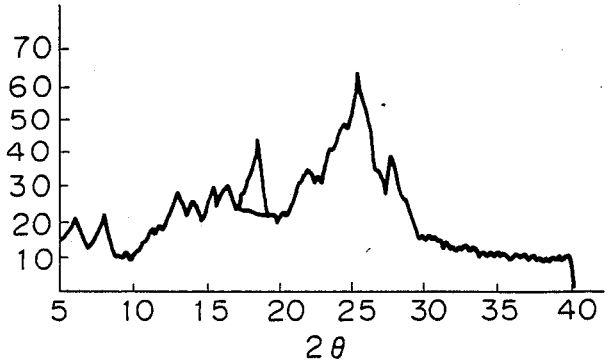
Figure 6:
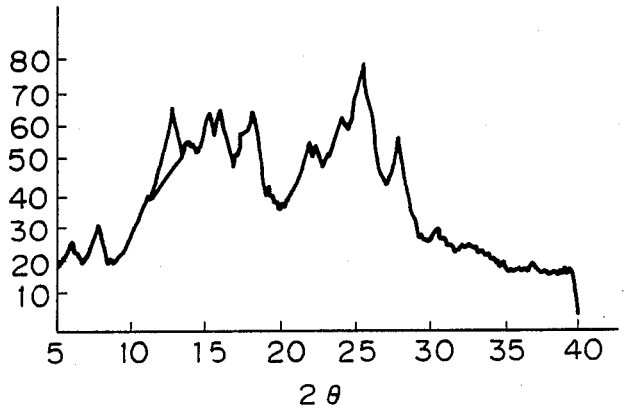
Figure 7:
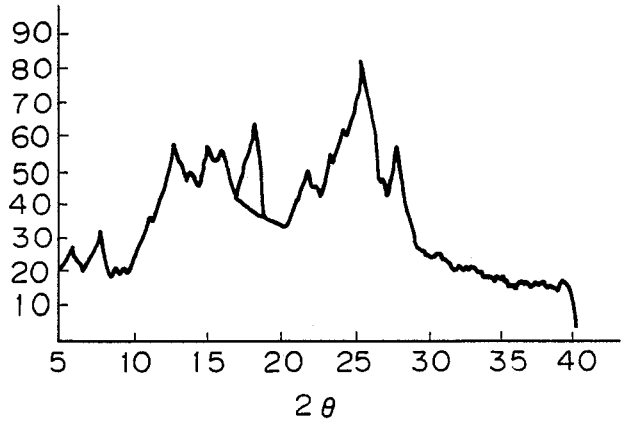

| | Charge characteristics | | Crystallization degree (X) of charge-generating material | | |
|---|---|---|---|---|---|
| | $V_O$ (−V) | E1/5 (μJ/cm²) | Before dispersing | Dispersions | Photosensitive layer |
| Example: | | | | | |
| 1 | 600 | 1.6 | X = 0.33 (cf. FIG. 1) | X = 1.20 (cf. FIG. 2) | X = 1.43 (cf. FIG. 3) |
| 2 | 610 | 1.9 | — | X = 0.81 (cf. FIG. 4) | X = 0.82 (cf. FIG. 5) |
| Comparative Example: | | | | | |
| 1 | 590 | 4.2 | — | X = 0.44 (cf. FIG. 6) | X = 0.62 (cf. FIG. 7) |

Thus, the photosensitive members wherein the crystallization degree in the photosensitive layer was controlled to 0.8 or more show superior characteristics in regard to the sensitivity, particularly the sensitivity in the near infrared region.

EXAMPLE 3

Example 1 was exactly repeated to prepare a photosensitive member, except that Exemplary Compound (13) was used in place of the disazo pigment used in Example 1 and the time for the dispersing using the sand mill apparatus was changed to 30 hours, and the charge characteristics and powder X-ray diffraction were measured similarly. Results obtained are shown in Table 2.

COMPARATIVE EXAMPLE 2

Example 3 was exactly repeated to prepare a photosensitive member, except that the dispersing solvent was replaced with THF in the dispersing using the sand mill apparatus in Example 3, and evaluation was made similarly. Results obtained are shown in Table 2.

TABLE 2

Figure 8:
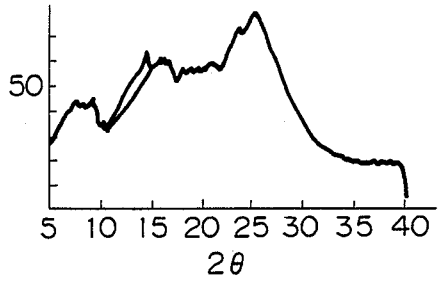
Figure 9:
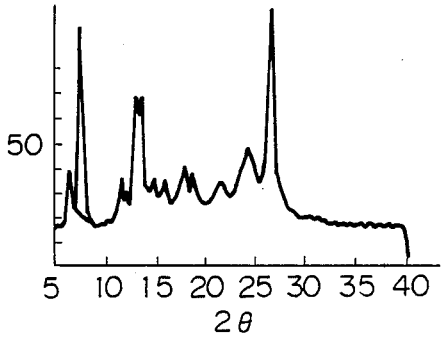

| | Charge characteristics | | Crystallization degree (X) of charge-generating material | |
|---|---|---|---|---|
| | $V_O$ (−V) | E1/5 (μJ/cm²) | Dispersions | Photosensitive layer |
| Example: | | | | |
| 3 | 620 | 1.8 | X = 0.18 (cf. FIG. 8) (cf. FIG. 9) | X = 4.0 |
| Comparative Example: | | | | |
| 2 | 610 | 3.8 | X = 0.10 | X = 0.33 |

TABLE 2-continued

Figure 10:
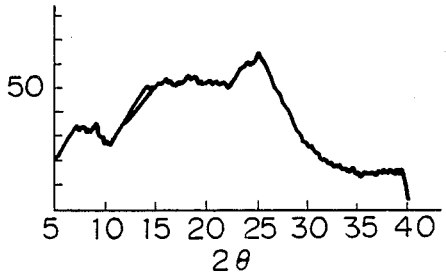
Figure 11:
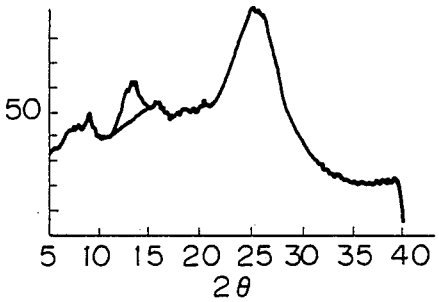

| Charge characteristics | | Crystallization degree (X) of charge-generating material | |
|---|---|---|---|
| $V_O(-V)$ | E1/5 ($\mu J/cm^2$) | Dispersions | Photosensitive layer |
| | | (cf. FIG. 10) | (cf. FIG. 11) |

EXAMPLE 4

Example 1 was exactly repeated to prepare a photosensitive member, except that Exemplary Compound (5) was used in place of the disazo pigment used in Example 1 and the time for the dispersing using the sand mill apparatus was changed to 15 hours. This photosensitive member was corona-charged under −5 kV according to a static system with use of an electrostatic copy paper test machine (Model SP-428, available from Kawaguchi Denki K.K.), and kept in the dark place for 1 second, followed by exposure under illumination of 5 lux to examine its charge characteristics. Measured as the charge characteristics were the surface potential ($V_o$) and the exposure amount (E1/5) required for decaying to 1/5 the potential in dark-decaying for 1 second. The charge-generating material was also collected from the above photosensitive member to make measurement of the powder X-ray diffraction. Results obtained are shown in Table 3.

COMPARATIVE EXAMPLE 3

Example 3 was exactly repeated to prepare a photosensitive member, except that the disazo pigment used in Example 4 was dispersed for 3 hours using the sand mill, and evaluation was similarly made. Results obtained are shown in Table 3.

TABLE 3

Figure 12:
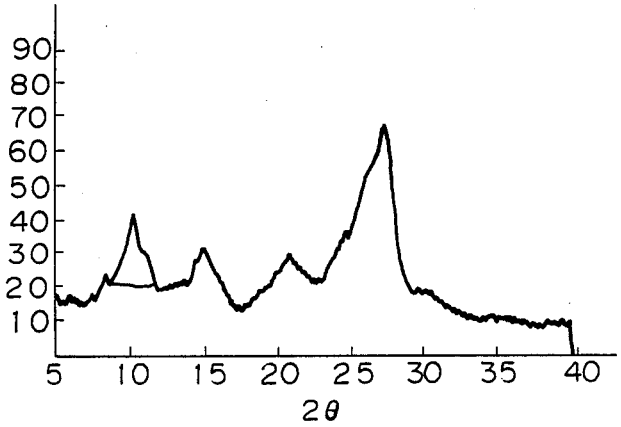
Figure 13:
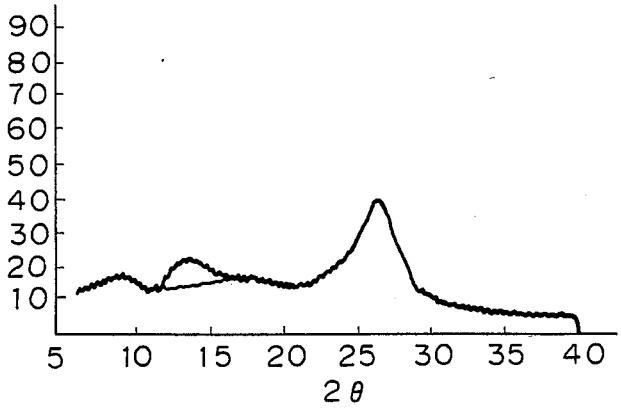

| | Charge characteristics | | Crystallization degree (X) of charge-generating material Photosensitive layer |
|---|---|---|---|
| | $V_O(-V)$ | E1/5 (lux/sec) | |
| Example: | | | |
| 4 | 610 | 2.1 | X = 1.1 (cf. FIG. 12) |
| Comparative Example: | | | |
| 3 | 580 | 4.5 | X = 0.44 (cf. FIG. 13) |

EXAMPLE 5

Using the electrophotographic photosensitive members used in Examples 1 and 2 and Comparative Example 1, measured was fluctuation of dark portion potential ($V_o$) and light portion potential ($V_L$) when used repeatedly.

The measurement was carried out by pasting the above photosensitive member onto a cylinder of an electrophotographic copying machine equipped with a corona charger of −5.6 kV, a light-exposure optical system comprising a semiconductor laser (780 nm), a developing unit, a transfer charger, a deelectrifying light-exposure optical system and a cleaner, and the initial dark portion potential ($V_O$) and light portion potential ($V_L$) were set to −600 V and −100 V, respectively, to measure the dark portion potential ($V_O$) and light portion ($V_L$) after 5,000 time repetition. Results obtained are shown in Table 4.

TABLE 4

| Photosensitive member | Initial stage | | After 5,000 time duration | |
|---|---|---|---|---|
| | $V_O(-V)$ | $V_L(-V)$ | $V_O(-V)$ | $V_L(-V)$ |
| Example 1 | 600 | 100 | 600 | 110 |
| Example 2 | 600 | 100 | 610 | 120 |
| Comparative Example 1 | 600 | 100 | 660 | 240 |

What is claimed is:

1. An electrophotographic photosensitive member comprising a conductive support, and a photosensitive layer containing an azo pigment as a charge-generating material, wherein in a powder X-ray diffraction pattern of the azo pigment contained in said photosensitive layer the ratio (X) of the diffracted beam intensity at a maximum peak of $2\theta$ of from 5° to 20° to the X-ray intensity at the background is 0.8 or more, provided that:

$$X=(P-B)/B$$

P: X-ray intensity at a peak position at the maximum peak; and

B: X-ray intensity at a peak position on the line connecting the bottoms at the both sides of the maximum peak.

2. The electrophotographic photosensitive member of claim 1, wherein said X is 1.0 or more.

3. The electrophotographic photosensitive member of claim 1, wherein X pertaining to the charge-generating material in a charge-generating material dispersion before preparing the electrophotographic photosensitive member is 0.8 or more.

4. The electrophotographic photosensitive member of claim 1, wherein said azo pigment is a disazo pigment.

5. The electrophotographic photosensitive member of claim 1, wherein said photosensitive layer has a laminated structure comprising a charge generation layer containing the charge-generating material and a charge transport layer containing a charge-transporting material.

6. The electrophotographic photosensitive member of claim 1, wherein said charge transport layer is laminated on said charge generation layer.

7. The electrophotographic photosensitive member of claim 1, wherein said photosensitive layer has a single layer type that the charge-generating material and the charge-transporting material are contained in the same layer.

* * * * *

UNITED STATES PATENT AND TRADEMARK OFFICE

CERTIFICATE OF CORRECTION

PATENT NO. :4,888,261

DATED :December 19, 1989

INVENTOR(S) :MINORU MABUCHI

It is certified that error appears in the above-identified patent and that said Letters Patent is hereby corrected as shown below:

ON THE TITLE PAGE,
IN [54] TITLE

"PHOTSENSITIVE" should read --PHOTOSENSITIVE--.

IN [57] ABSTRACT

Line 3, "as" (first occurrence) should read --an--.

COLUMN 1

Line 2, "PHOTSENSITIVE" should read --PHOTOSENSITIVE--.
Line 28, "advantage" should read --advantages--.

COLUMN 3

Line 53, "depos-" should read --are depos- --.
Line 55, "materials" should read --material--.
Line 56, "power" should read --powder--.
Line 67, "enables" should read --enable--.

COLUMN 5

Line 33, "any" should read --all--.

COLUMN 6

Line 3, "laminated" should read --be laminated--.
Line 25, "fluolenone," should read --fluorenone,--.
Line 26, "fluolenone," should read --fluorenone,--.

UNITED STATES PATENT AND TRADEMARK OFFICE

CERTIFICATE OF CORRECTION

PATENT NO. : 4,888,261

DATED : December 19, 1989

INVENTOR(S) : MINORU MABUCHI

It is certified that error appears in the above-identified patent and that said Letters Patent is hereby corrected as shown below:

COLUMN 6

Line 55, "4-p-dimethylaminophenyl)" should read --4-(p-dimethylaminophenyl)--.

Line 68, "along" should read --alone--.

COLUMN 7

Line 29, "indium" should read --indium,--.

COLUMN 15

Line 15, "Toray K.K." should read --Toray K.K.)--.

COLUMN 16

Line 7, "amount E1/5)" should read --amount (E1/5)--.

TABLE 2, " X = 0.18 (cf. FIG. 8)(cf. FIG. 9) X = 4.0 "

should read -- X = 0.18 (cf. FIG. 8) X = 4.0 (cf. FIG. 9) --.

UNITED STATES PATENT AND TRADEMARK OFFICE

CERTIFICATE OF CORRECTION

PATENT NO. : 4,888,261

DATED : December 19, 1989

INVENTOR(S) : MINORU MABUCHI

It is certified that error appears in the above-identified patent and that said Letters Patent is hereby corrected as shown below:

COLUMN 17

TABLE 3, " Crystallization degree (X) of charge-generating material Photosensitive layer "

should read -- Crystallization degree (X) of charge-generating material Photosensitive layer --.

Signed and Sealed this

Twentieth Day of August, 1991

*Attest:*

*Attesting Officer*

HARRY F. MANBECK, JR.

*Commissioner of Patents and Trademarks*